US005599441A

United States Patent [19]

Collins et al.

[11] Patent Number: 5,599,441

[45] Date of Patent: Feb. 4, 1997

[54] ALKYLATION PROCESS FOR DESULFURIZATION OF GASOLINE

[75] Inventors: Nick A. Collins, Medford, N.J.; Jeffrey C. Trewella, Kennett Square, Pa.

[73] Assignee: Mobil Oil Corporation, Fairfax, Va.

[21] Appl. No.: 455,747

[22] Filed: May 31, 1995

[51] Int. Cl.[6] ..... C10G 35/04

[52] U.S. Cl. ..... 208/208 R; 208/134; 208/211

[58] Field of Search ..... 208/208 R, 134, 208/211

[56] References Cited

U.S. PATENT DOCUMENTS

| | | | |
|---|---|---|---|
| 2,114,852 | 4/1938 | McKittrick | 196/24 |
| 3,565,793 | 2/1971 | Herbstman et al. | 208/208 |
| 3,660,967 | 5/1972 | Collins et al. | 55/73 |
| 4,171,260 | 10/1979 | Farcasiu et al. | 208/240 |
| 4,871,444 | 10/1989 | Chen . | |
| 5,171,916 | 12/1992 | Le . | |
| 5,318,690 | 6/1994 | Fletcher et al. | 208/89 |
| 5,320,742 | 6/1994 | Fletcher . | |
| 5,382,706 | 1/1995 | Gonzalez et al. | 568/697 |

*Primary Examiner*—Helane Myers

*Attorney, Agent, or Firm*—Ronald A. Bleeker; Malcolm D. Keen

[57] ABSTRACT

Sulfur species present in cracked naphthas are converted and removed by first passing the naphtha over an acid catalyst to alkylate the thiophenic compounds in the naphtha using the olefins, i.e., monoolefins and diolefins, present in the naphtha as alkylating agent. Alkylated thiophenes are concentrated in the heavy portion of the naphtha by distillation, reducing the amount of naphtha that needs to be hydrodesulfurized. Olefins in cracked naphthas are concentrated in the light portion of the naphtha which is not subsequently hydrotreated. Thus, octane and hydrogen consumption penalties associated with hydrotreating are minimized.

22 Claims, 1 Drawing Sheet

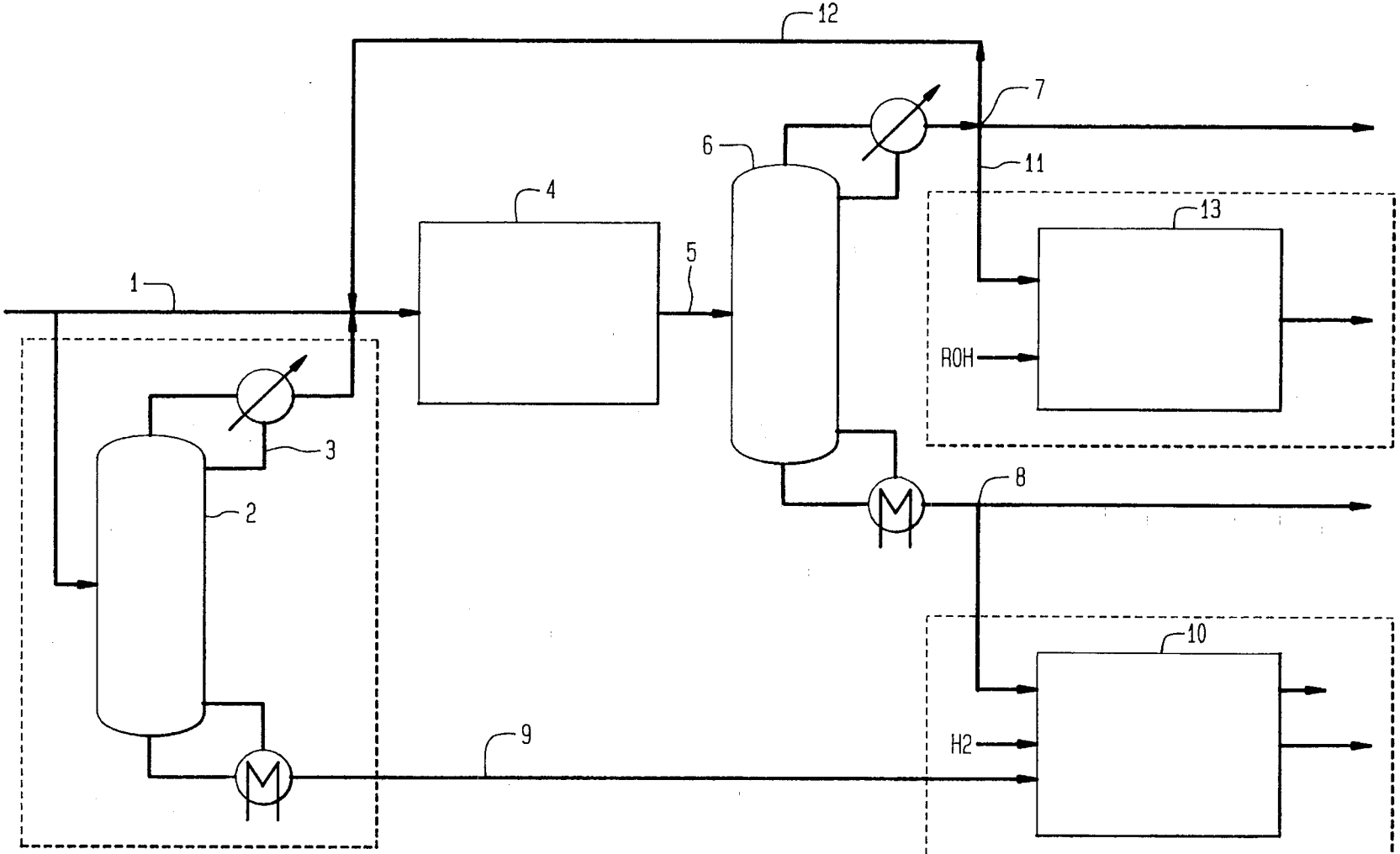
FIGURE

ALKYLATION PROCESS FOR DESULFURIZATION OF GASOLINE

FIELD OF THE INVENTION

This invention relates to a process for the upgrading of hydrocarbon streams. The invention more particularly relates to a process for upgrading gasoline boiling range petroleum fractions containing olefins and substantial proportions of sulfur impurities.

BACKGROUND OF THE INVENTION

Heavy petroleum fractions, such as vacuum gas oil, or even resids such as atmospheric resid, may be catalytically cracked to lighter and more valuable products, especially gasoline. Catalytically cracked gasoline forms a major part of the gasoline product pool in the United States. The product of catalytic cracking is conventionally recovered and the products fractionated into various fractions such as light gases; naphtha, including light and heavy gasoline; distillate fractions, such as heating oil and Diesel fuel; lube oil base fractions; and heavier fractions.

Sulfur in various forms is commonly found in petroleum and petroleum products either as dissolved free sulfur, hydrogen sulfide, or as organic compounds, such as thiophenes, sulfonic acids, mercaptans, alkylsulfates, and alkyl sulfides. Where a petroleum fraction is being catalytically cracked and contains sulfur, the products of catalytic cracking usually contain sulfur impurities which normally require removal, usually by hydrotreating, in order to comply with the relevant product specifications. Such hydrotreating can be done either before or after catalytic cracking. Because naphtha streams from both catalytic, e.g., FCC, and thermal, e.g.,coking, cracking processes contribute most of the sulfur present in the gasoline pool, reducing the sulfur content of cracked naphthas will be important in order to meet liquid transportation sulfur specifications and emission standards.

The ease of sulfur removal from petroleum and its products is dependent upon the type of sulfur-containing compound. Hydrogen sulfide and mercaptans are relatively easy to remove whereas aromatic sulfur compounds such as thiophenes are more difficult to remove. Sulfur impurities tend to concentrate in the heavy fraction of the gasoline, as noted in U.S. Pat. No. 3,957,625 (Orkin) which proposes a method of removing the sulfur by hydrodesulfurization of the heavy fraction of the catalytically cracked gasoline so as to retain the octane contribution from the olefins which are found mainly in the lighter fraction. In one type of conventional, commercial operation, the heavy gasoline fraction is treated in this way. As an alternative, the selectivity for hydrodesulfurization relative to olefin saturation may be shifted by suitable catalyst selection, for example, by the use of a magnesium oxide support instead of the more conventional alumina.

In the hydrotreating of petroleum fractions, particularly naphthas, and most particularly heavy cracked gasoline, the molecules containing the sulfur atoms are mildly hydrocracked so as to release their sulfur, usually as hydrogen sulfide. After the hydrotreating operation is complete, the product may be fractionated, or even just flashed, to release the hydrogen sulfide and collect the now sweetened gasoline. For naphtha hydrotreating, the naphtha is contacted with a suitable hydrotreating catalyst at elevated temperature and somewhat elevated pressure in the presence of a hydrogen atmosphere. One suitable family of catalysts which has been widely used for this service is a combination of a Group VIII and a Group VI element, such as cobalt and molybdenum, on a suitable substrate, such as alumina.

Naphthas, including light and full range naphthas, may be subjected to catalytically reforming so as to increase their octane numbers by converting at least a portion of the paraffins and cycloparaffins in them to aromatics. Fractions to be fed to catalytic reforming also need to be desulfurized before reforming because reforming catalysts are generally not sulfur tolerant. Thus, naphthas are usually pretreated by hydrotreating to reduce their sulfur content before reforming.

Aromatics are generally the source of high octane number, particularly very high research octane numbers and are therefore desirable components of the gasoline pool. They have, however, been the subject of severe limitations as a gasoline component because of possible adverse effects on the ecology, particularly with reference to benzene. It has therefore become desirable, as far as is feasible, to create a gasoline pool in which the higher octanes are contributed by the olefinic and branched chain paraffinic components, rather than the aromatic components. Light and full range naphthas can contribute substantial volume to the gasoline pool, but without reforming or isomerization they do not generally contribute significantly to higher octane values.

Cracked naphtha, as it comes from the catalytic cracker and without any further treatments such as purifying operations, has a relatively high octane number as a result of the presence of olefinic components. It also has an excellent volumetric yield. As such, cracked gasoline is an excellent contributor to the gasoline pool. It contributes a large quantity of product at a high blending octane number. In some cases, this fraction may contribute as much as up to half the gasoline in the refinery pool. Therefore, it is one of the most desirable components of the gasoline pool, and it should not be lightly tampered with.

Other highly unsaturated fractions boiling in the gasoline boiling range, which are produced in some refineries or petrochemical plants, include pyrolysis gasoline. This is a fraction which is often produced as a by-product in the cracking of petroleum fractions to produce light unsaturates, such as ethylene and propylene. Pyrolysis gasoline may have a very high octane number but is quite unstable in the absence of hydrotreating because, in addition to the desirable olefins boiling in the gasoline boiling range, it also contains a substantial proportion of diolefins, which tend to form gums upon storage or standing.

Cracking of naphtha is a highly useful process to increase the yield of gasoline. However, the cracking process also effects sulfur containing materials and results in a reduction in their molecular weight from a range that is greater than the average molecular weight of the gasoline boiling range fraction into a range that is within the molecular weight range of the gasoline fraction. Much of this gasoline boiling range sulfur is contained in aromatic compounds and, consequently, needs to removed by hydrotreating. However, hydrotreating of any of the sulfur containing cracked fractions which boil in the gasoline boiling range, e.g., FCC, pyrolysis and coker naphtha, causes a reduction in the olefin content, and consequently a reduction in the octane number. Further, as the degree of desulfurization increases, the octane number of the normally liquid gasoline boiling range product decreases. Depending on the conditions of the hydrotreating operation, some of the hydrogen may also cause some hydrocracking or aromatic saturation as well as olefin saturation.

Various proposals have been made for removing sulfur while retaining the more desirable olefins. U.S. Pat. No. 4,049,542 (Gibson), for instance, discloses a process in which a copper catalyst is used to desulfurize an olefinic hydrocarbon feed such as catalytically cracked light naphtha.

Other processes for treating catalytically cracked gasolines have also been proposed in the past. For example, U.S. Pat. No. 3,759,821 (Brennan) discloses a process for upgrading catalytically cracked gasoline by fractionating it into a heavier and a lighter fraction and treating the heavier fraction over a ZSM-5 catalyst, after which the treated fraction is blended back into the lighter fraction. Another process in which the cracked gasoline is fractionated prior to treatment is described in U.S. Pat. No. 4,062,762 (Howard) which discloses a process for desulfurizing naphtha by fractionating the naphtha into three fractions each of which is desulfurized by a different procedure, after which the fractions are recombined.

In any case, regardless of the mechanism by which it happens, the decrease in octane which takes place as a consequence of sulfur removal by hydrotreating creates a tension between the growing need to produce gasoline fuels with higher octane number and—because of current ecological considerations—the need to produce cleaner burning, less polluting fuels, especially low sulfur fuels to avoid poisoning of catalyst converters which would adversely affect hydrocarbon emissions. This inherent tension is yet more marked in the current supply situation for low sulfur, sweet crudes.

A paramount objective of the present invention is to provide a process for reducing the sulfur level in naphtha streams while minimizing product losses in volume and octane number.

A particular objective of the present invention is to provide a process for reducing or lowering the amount of sulfur in naphtha attributable to thiophene or thiophenic compounds.

Yet a further objective of the invention is to provide a process for alkylating thiophenic sulfur compounds in naphtha to allow their subsequent separation from naphtha by fractional distillation with a concomitant reduction sulfur content of gasoline boiling range hydrocarbons.

SUMMARY OF THE INVENTION

The essence of the present invention is the discovery that the sulfur species present in cracked naphthas may be converted and removed by first passing the naphtha over an acid catalyst to alkylate the thiophenic compounds in the naphtha using the indigenous olefins present in the naphtha as alkylating agent. Such alkylation reactions provide alkylated thiophenes that concentrate the sulfur species in the heavy portion of the naphtha, greatly reducing the amount of naphtha that needs to be hydrodesulfurized. Furthermore, because the majority of the olefins in cracked naphthas remain concentrated in the light portion of the naphtha which is not subsequently hydrotreated, the octane and hydrogen consumption penalties associated with the hydrotreating of only the sulfur-enriched heavy naphtha are minimized. Similar results can be achieved through the process of the invention with virgin naphthas having a low olefin content by cofeeding olefin-rich streams.

More particularly, the invention comprises a process for upgrading a sulfur-containing feedstream comprising olefinic gasoline boiling range hydrocarbons rich in thiophenic sulfur compounds. The process is carried out by contacting the feedstream with acidic alkylation catalyst particles under alkylation conditions in an alkylation zone to provide an effluent stream comprising hydrocarbons containing alkylated thiophenic sulfur compounds. The alkylated thiophenic compounds are separated from the effluent stream by fractional distillation to provide a heavy naphtha of higher boiling point rich in alkylated thiophenic compounds and a light naphtha portion. The light naphtha portion is recovered to provide gasoline boiling range hydrocarbons containing a reduced amount of thiophenic sulfur compounds. Optionally, the heavy naphtha portion may be desulfurized using conventional hydrotreating or other desulfurization processes.

While the process of the invention specifically achieves the intended benefit of a lowering of the sulfur content of the naphtha feedstream, there are corollary benefits. It is to be expected that the process of the invention will also lower the amount of aromatic nitrogen compounds in the naphtha as well as the amount of diolefins.

DESCRIPTION OF THE DRAWING

The FIGURE is a schematic drawing of one embodiment of the process of the invention.

DETAILED DESCRIPTION OF THE INVENTION

The Feed

The feed to the process comprises a sulfur-containing petroleum fraction, generally olefinic, which boils in the gasoline boiling range. Feeds of this type include olefinic light naphthas typically having a boiling range of about $C_6$ to 330° F., full range naphthas typically having a boiling range of about $C_5$ to 420° F., heavier naphtha fractions boiling in the range of about 260° F. to 412° F., or heavy gasoline fractions boiling at, or at least within, the range of about 330° to 500° F., preferably about 330° to 412° F. The preferred feed is a light naphtha or full range naphtha. The specific intent of the process is to remove sulfur compounds in the light fraction.

While the feedstream to the process preferably comprises a sulfur-containing olefinic petroleum fraction which boils in the gasoline boiling range wherein indigenous olefins are used to carry out the alkylation reaction, it is within the scope of the invention to optionally employ an additional or cofeed olefin feedstream to the process to provide or supplement alkylating agents for the process. This optional variation of the process could be elected depending on conditions extant in the refinery, including an abundant supply of light olefins or a sulfur-rich gasoline boiling range stream that is not sufficiently rich in indigenous olefins.

The process may be operated with the entire gasoline fraction obtained from the catalytic cracking step or, alternatively, with part of it. Because the sulfur tends to be concentrated in the higher boiling fractions, it is preferable, particularly when unit capacity is limited, to separate the higher boiling fractions and process them through the steps of the present process without processing the lower boiling cut. The cut point between the treated and untreated fractions may vary according to the sulfur compounds present but usually, a cut point in the range of from about 100° F. (38° C.) to about 300° F. (150° C.), more usually in the range of about 200° F.(93° C.) to about 300° F.(150° C.) will be suitable. The exact cut point selected will depend on the sulfur specification for the gasoline product as well as on the type of sulfur compounds present: lower cut points will typically be necessary for lower product sulfur specifications. Sulfur which is present in components boiling below about 150° F.(65° C.) is mostly in the form of mercaptans which may be removed by extractive type processes such as Merox. Removal of thiophenic compounds and present in higher boiling components, e.g., component fractions boiling above about 180° F.(82° C.), is carried out according to the process of the instant invention.

The sulfur content of these catalytically cracked fractions will depend on the sulfur content of the feed to the cracker as well as on the boiling range of the selected fraction used as the feed in the process. Lighter fractions, for example, will tend to have lower sulfur contents than the higher boiling fractions. As a practical matter, the sulfur content will exceed 50 ppmw and usually will be in excess of 100 ppmw, and in most cases in excess of about 500 ppmw. For the fractions which have 95 percent points over about 380° F.(19– 3° C.), the sulfur content may exceed about 1,000 ppmw and may be as high as 4,000 or 5,000 ppmw or even higher. Since much of the nitrogen compounds in the feed to a cracker end up as coke, the nitrogen content of cracked naphtha is not as characteristic of the feed as is the sulfur content and is preferably not greater than about 20 ppmw although higher nitrogen levels typically up to about 50 ppmw may be found in certain higher boiling feeds with 95 percent points in excess of about 380° F.(193° C.). The nitrogen level will, however, usually not be greater than 250 or 300 ppmw. As a result of the cracking which has preceded the steps of the present process, the feed to the process of the invention will be olefinic, with an olefin content of at least 3 and more typically in the range of 10 to 20, e.g. 15–20, weight percent.

The Catalyst

Many heterogeneous acid catalysts containing either Bronsted acid sites or Lewis acid sites are useful for the process of the invention. Typical Lewis acids include those derived from $AlCl_3$, $FeCl_3$, $SbCl_3$, $BF_3$, $ZnCl_2$, $TiC_{14}$ and $P_2O_5$; but particularly, Lewis acids such as $AlCl_3$/silica, $AlCl_2$/silica, $BF_3$/silica, Co/Mo/alumina, Mo/alumina, $MoS_2$ are useful for the process of the invention. Typical Bronsted acids include HF, $H_2SO_4$, metallosilicates, silica-alumina, sulfonic acid resins, and the like. Well-known methods of maintaining or recovering catalyst activity, such as promoter cofeed or hydrogenative or oxidative regeneration, may also be employed.

The catalysts useful in the conversion step of the present invention include the crystalline aluminosilicate zeolites having a silica to alumina ratio of at least 12, and constraint index of about 1 to 12. Representative of the ZSM-5 type zeolites are ZSM-5, ZSM-11, ZSM-22, ZSM-23, ZSM-35, MCM-22, MCM-36, MCM-49, MCM-49 and ZSM-48. ZSM-5 is disclosed and claimed in U.S. Pat. No. 3,702,886 and U.S. Pat. No. Reissue. 29,948; ZSM-11 is disclosed and claimed in U.S. Pat. No. 3,709,979.

The larger pore zeolites which are useful as catalysts in the process of this invention, i.e., those zeolites having a Constraint Index of no greater than about 2, are well known to the art. Representative of these zeolites are zeolite Beta, TEA mordenite, faujasites, USY and ZSM-12.

Zeolite Beta is described in U.S. Reissue Pat. No. 28,341 (of original U.S. Pat. No. 3,308,069), to which reference is made for details of this catalyst.

Zeolite ZSM-12 is described in U.S. Pat. No. 3,832,449, to which reference is made for the details of this catalyst.

The method by which Constraint Index is determined is described fully in U.S. Pat. No. 4,016,218, to which reference is made for details of the method.

The preferred catalysts for use in the present invention are member of the MCM-22 group which includes MCM-22, MCM-36, MCM-49 and MCM-56. MCM-22 is described in U.S. Pat. No. 4,954,325. MCM-36 is described in U.S. Pat. No. 5,250,277 and MCM-36 (bound) is described in U.S. Pat. No. 5,292,698. MCM-49 is described in U.S. Pat. No. 5,236,575 and MCM-56 is described in U.S. Pat. No. 5,362,697.

The Process

The process of the invention reduces the sulfur level in naphtha streams while minimizing volume and octane loss. Olefins, either present in cracked naphthas or fed to virgin naphtha, are used to convert sulfur species to higher molecular weight compounds thereby concentrating the sulfur in the "back-end"of the naphtha. Upon fractionation, this redistribution of the sulfur in the naphtha leads to a relatively sulfur-free light naphtha and a sulfur-rich heavy naphtha which may be desulfurized via conventional hydrotreating. Conversion of the sulfur in the heavy fraction of naphtha reduces the amount of naphtha that must be hydrodesulfurized which, in the case of cracked naphthas, leads to lower hydrogen consumption and greater octane-barrels.

The conversion carried out in the process is one of alkylation of aromatic heterocyclic sulfur compounds, i.e., thiophene and related thiophenic compounds, in contact with acidic alkylation catalyst. Preferably, the process is carried out on a cracked naphtha feedsteam at temperatures between 100° F. (38° C.) and 700° F. (371° C.) and pressure between atmospheric or autogenous pressure and 7000 kPa. The preferred temperature is 300°–400° F. (149°–204° C.).

Various reactor configurations can be employed to carry out the alkylation step of the process of the invention. These include a down-flow, liquid phase, fixed bed process; an up-flow, fixed bed, trickle phase process; an ebulating, fluidized bed process; or a transport, fluidized bed process. All of these different process schemes are generally well known in the petroleum arts, and the choice of the particular mode of operation is a matter left to the discretion of the operator, although the fixed bed arrangements are preferred for simplicity of operation.

A series of experiments was performed to illustrate the novelty and advantages of the invention. These experiments are depicted in the following composite Example 1.

EXAMPLE 1

Selective condensation of sulfur compounds in cracked naphthas was scoped over zeolite catalysts ZSM-5, MCM-22, and USY in batch studies. Feedstocks included both light ($C_5$—210° F., 230 ppmw S) and full-range ($C_5^+$, 0.14 wt % S) FCC naphthas. These batch runs were conducted at 350° F. for three hours at autogenous pressure with loadings of 10 grams of light naphtha per gram of catalyst and 11.6 grams of full-range naphtha per grams of catalyst. Results for the light FCC are shown in Table 1 and for the full-range FCC in Table 2.

TABLE 1

Light FCC Naphtha Sulfur Redistribution

| | Acid Catalyst | | | |
|---|---|---|---|---|
| | Feed | ZSM-5 | MCM-22 | USY |
| Sulfur Distribution, wt % of S | | | | |
| <Thiophene | 16.8 | 0.0 | 0.0 | 0.0 |
| Thiophene | 44.5 | 0.0 | 0.0 | 8.8 |
| Methylthiophenes | 33.2 | 0.0 | 0.0 | 0.0 |
| >Methylthiophenes | 5.5 | 100.0 | 100.0 | 91.2 |
| Total | 100.0 | 100.0 | 100.0 | 100.0 |
| Composition, wt % of HC | | | | |
| Butenes | 1.0 | 0.7 | 0.0 | 0.8 |
| Pentenes | 26.8 | 11.5 | 2.0 | 16.3 |
| Hexenes | 19.7 | 11.4 | 3.2 | 14.6 |
| $C_4$–$C_6$ P + N + A | 27.6 | 32.8 | 35.9 | 34.3 |
| $C_7$+ | 24.9 | 43.7 | 59.0 | 34.1 |
| Total | 100.0 | 100.0 | 100.0 | 100.0 |

TABLE 2

Full-range FCC Naphtha Sulfur Redistribution

| | Acid Catalyst | | | |
|---|---|---|---|---|
| | Feed | ZSM-5 | MCM-22 | USY |
| Sulfur Distribution, wt % of S | | | | |
| <Benzothiophene | 51.7 | 22.5 | 14.9 | 15.7 |
| Benzothiophene | 27.8 | 24.1 | 9.0 | 13.5 |
| >Benzothiophene | 20.4 | 53.4 | 76.1 | 70.8 |
| Total | 100.0 | 100.0 | 100.0 | 100.0 |
| Composition, wt % of HC | | | | |
| >430° F. (Benzothiophene) | 5.2 | 8.6 | 10.7 | 10.1 |

As shown in Table 1, all three catalysts were extremely effective in converting the sulfur compounds present in the light FCC naphtha feed to sulfur species boiling above the methylthiophenes (235°–240° F.) and $C_7$olefins (177°–223° F.). This sulfur conversion was also accompanied by significant olefin conversion to $C_7^+$ products as shown in the detailed hydrocarbon composition.

All three catalysts were also effective in converting sulfur species present in full-range FCC naphtha as shown in Table 2.

A preferred implementation of the proposed concept is shown schematically in the Figure. Cracked naphtha (1), possibly prefractionated (2) to obtain a light fraction (3), is fed to a condensation or alkylation reactor (4) containing acid catalyst where naphtha-range olefins alkylate sulfur species producing heavier sulfur compounds. The reactor effluent (5) is distilled (6) to obtain low-sulfur light naphtha (7) and a heavy naphtha (8) enriched in sulfur. This high-sulfur heavy naphtha may be combined with heavy naphtha (9) from the prefractionator and hydrodesulfurized in reactor (10) using conventional hydrotreating processes or alternatively sent to the distillate pool. The low-sulfur light naphtha (7) may be optionally etherified (11) in etherification reactor (13) or optionally recycled (12) to the sulfur conversion reactor depending on overall desulfurization targets. The naphtha splitter may also have utility in meeting $T_{90}$ distillation targets.

What is claimed is:

1. A process for upgrading a cracked naphtha sulfur-containing feedstream comprising olefinic gasoline boiling range hydrocarbons rich in olefins and thiophenic sulfur compounds, said process comprising the following serial steps:

first, contacting said feedstream having a boiling range between $C_5$ and 420° F. with acidic alkylation catalyst particles under alkylation conditions in an alkylation zone wherein said olefins act as alkylating agents to alkylate said thiophenic sulfur compounds to provide an effluent stream comprising alkylated thiophenic sulfur compounds and olefinic gasoline boiling range hydrocarbons;

separating said alkylated thiophenic compounds from said olefinic gasoline boiling range hydrocarbons by fractional distillation; and recovering a product stream comprising said hydrocarbons containing a reduced amount of said thiophenic sulfur compounds.

2. The process of claim 1 wherein said feedstream comprises a light naphtha from fluid catalytic cracking and at least 90 weight percent of said thiophenic sulfur compounds are converted to alkylated thiophenic sulfur compounds.

3. The process of claim 1 wherein said catalyst particles comprise heterogeneous acid catalysts containing Bronsted acid sites.

4. The process of claim 1 wherein said catalyst particles comprise heterogeneous acid catalysts containing Lewis acid sites.

5. The process of claim 3 wherein said catalyst particles are selected form the group consisting of metallosilicates, silica-alumina and sulfonic acid resins.

6. The process of claim 4 wherein said catalyst particles are selected form the group consisting of $AlCl_3$, $AlCl_2$/silica Co/Mo/alumina, Mo/alumina, $MoS_2$ and silica-alumina.

7. The process of claim 1 wherein said catalyst particles comprise aluminosilicate zeolite particles.

8. The process of claim 7 wherein said aluminosilicate particles are selected from the group consisting of ZSM-5, MCM-22, MCM-56, zeolite beta, USY and faujasite.

9. The process of claim 1 in which said feedstream comprises a light naphtha fraction having a boiling range within the range of $C_6$ to 330° F.

10. The process of claim 1 in which said feed stream comprises a full range naphtha fraction having a boiling range within the range of $C_5$ to 420° F.

11. The process of claim 1 in which said feed stream comprises a heavy naphtha fraction having a boiling range within the range of 330°to 500° F.

12. The process of claim 1 in which said feed stream comprises a heavy naphtha fraction having a boiling range within the range of 330°to 412° F.

13. The process of claim 1 in which said feedstream is a cracked naphtha fraction comprising olefins.

14. The process of claim 1 in which said feed stream comprises a naphtha fraction having a 95 percent point of at least about 350° F.

15. The process of claim 14 in which said feed stream comprises a naphtha fraction having a 95 percent point of at least about 380° F.

16. The process of claim 15 in which said feed stream comprises a naphtha fraction having a 95 percent point of at least about 400° F.

17. The process of claim 1 wherein said alkylation conditions comprise temperature between 100° F. and 700° F. and pressure between atmospheric pressure and 7000 kPa.

18. The process of claim 17 wherein said temperature is 300°–400° F.

19. The process of claim 1 wherein said alkylation zone comprises a fixed or fluid catalyst bed alkylation zone.

20. The process of claim 1 wherein said alkylation conditions comprise a catalyst loading of between 0.5 grams and grams per 10 grams of said feedstream.

21. The process of claim 1 wherein said feedstream contains diolefins as well as monoolefins and said product stream contains a reduced amount of said diolefins.

22. The process of claim 1 including the further step of cofeeding an olefin feedstream to said alkylation zone in conjunction with the gasoline boiling range hydrocarbon feedstream.

* * * * *